US006702639B1

(12) United States Patent
Tsai et al.

(10) Patent No.: US 6,702,639 B1
(45) Date of Patent: Mar. 9, 2004

(54) STICK FUSELAGE OF TOY PLANE

(76) Inventors: Yu-Chi Tsai, P.O. Box 487, Changhua City (TW), 500; Ming-Hung Hsieh, P.O. Box 487, Changhua City (TW), 500

( * ) Notice: Subject to any disclaimer, the term of this patent is extended or adjusted under 35 U.S.C. 154(b) by 0 days.

(21) Appl. No.: 10/326,984

(22) Filed: Dec. 24, 2002

(51) Int. Cl.[7] ..... A63H 27/00
(52) U.S. Cl. ..... 446/61; 446/66; D21/449
(58) Field of Search ..... D21/449; 446/61, 446/62, 63, 64, 65, 66, 67, 68, 59, 60, 57, 36, 37, 38, 39, 44

(56) References Cited

U.S. PATENT DOCUMENTS

| | | | | | |
|---|---|---|---|---|---|
| 3,590,517 | A | * | 7/1971 | Regehr et al. | 446/57 |
| 3,714,734 | A | * | 2/1973 | Livingston | 446/67 |
| 4,087,934 | A | * | 5/1978 | Gibson | 446/64 |
| 4,096,660 | A | * | 6/1978 | Ralph | 446/56 |
| 4,301,614 | A | * | 11/1981 | Newton | 446/68 |
| 4,307,536 | A | * | 12/1981 | English et al. | 446/67 |
| 4,531,323 | A | * | 7/1985 | Henning | 446/66 |
| 4,698,041 | A | * | 10/1987 | Dasa | 446/61 |
| 4,867,725 | A | * | 9/1989 | Smith | 446/34 |
| 5,205,771 | A | * | 4/1993 | Sims | 446/21 |
| 5,525,087 | A | * | 6/1996 | Chin-Lin | 446/59 |
| 5,683,250 | A | * | 11/1997 | Paivanas | 434/32 |
| 5,733,164 | A | * | 3/1998 | Albrecht | 446/63 |
| 5,741,168 | A | * | 4/1998 | Chen | 446/66 |
| 5,846,112 | A | * | 12/1998 | Baker | 446/68 |
| 5,947,785 | A | * | 9/1999 | Bausch | 446/59 |
| 6,544,092 | B1 | * | 4/2003 | Tomas | 446/35 |

FOREIGN PATENT DOCUMENTS

| | | | | |
|---|---|---|---|---|
| GB | 2277879 A | * | 11/1994 | A63H/27/01 |
| JP | 200042257 | * | 2/2000 | A63H/27/01 |

* cited by examiner

*Primary Examiner*—Derris H. Banks
*Assistant Examiner*—Urszula M Cegielnik

(57) ABSTRACT

A main form of stick fuselage of a toy plane has a cruciform cross section. The stick fuselage is formed by plastic material and is integrally formed with a main wing support framing and a tail unit framing. Moreover, a propeller axle bearing, a landing gear framing, a dihedral bracket jointer, a rear rubber hook, and a tail skid may be integrally formed with the main form of stick fuselage.

2 Claims, 8 Drawing Sheets

STICK FUSELAGE OF TOY PLANE

FIELD OF THE INVENTION

The present invention relates to toy planes, and particularly to a main form of stick fuselage.

BACKGROUND OF THE INVENTION

The traditional model planes are seldom sell in the toy market due to the complicated structure and complex assembly work. The main reason is that the assembly of the main wing, tail wing, support framing and other aeromechanic system is too tedious. However, currently, plastics are usable materials in the assembled toys. Therefore, it has an eager demand for a novel design of the toy plane which can be assembled and detached easily in a few seconds, and moreover plastics are used as the material of the fuselage so as to simplify the assembly of the toy plane.

SUMMARY OF THE INVENTION

Accordingly, the primary object of the present invention is to provide a main form of stick fuselage of a toy plane having a cruciform cross section. The main form of stick fuselage is formed by plastic material and is integrally formed with a main wing support framing and a tail unit framing. Moreover, a propeller axle bearing, a landing gear framing under the propeller axle bearing, the dihedral bracket jointer below the main wing support framing, a rear rubber hook, and a tail skid may be integrally formed with the main form of stick fuselage.

The various objects and advantages of the present invention will be more readily understood from the following detailed description when read in conjunction with the appended drawing.

DETAILED DESCRIPTION OF THE PREFERRED EMBODIMENTS

Figure 1:
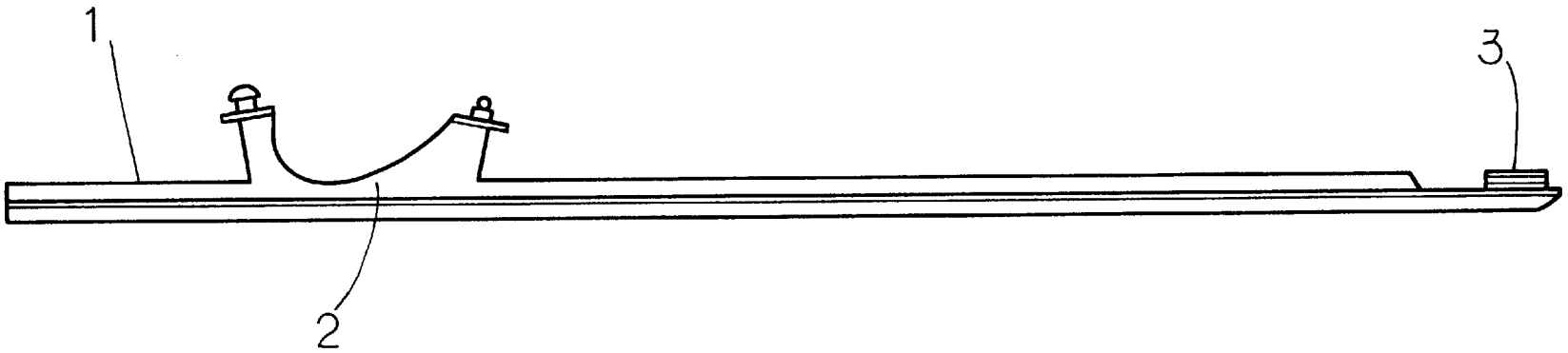
FIG. 1 is a lateral view showing the main form of stick fuselage, the main wing support framing and the tail unit framing of the present invention.

Referring to FIG. 1, the present invention includes a main form of stick fuselage 1, a main wing support framing 2 integrally formed with the main form of stick fuselage 1, and a tail unit framing 3 integrally formed with the main form of stick fuselage 1. Other components of the present invention will be described with reference to FIGS. 4, 5 and 6.

Figure 2:
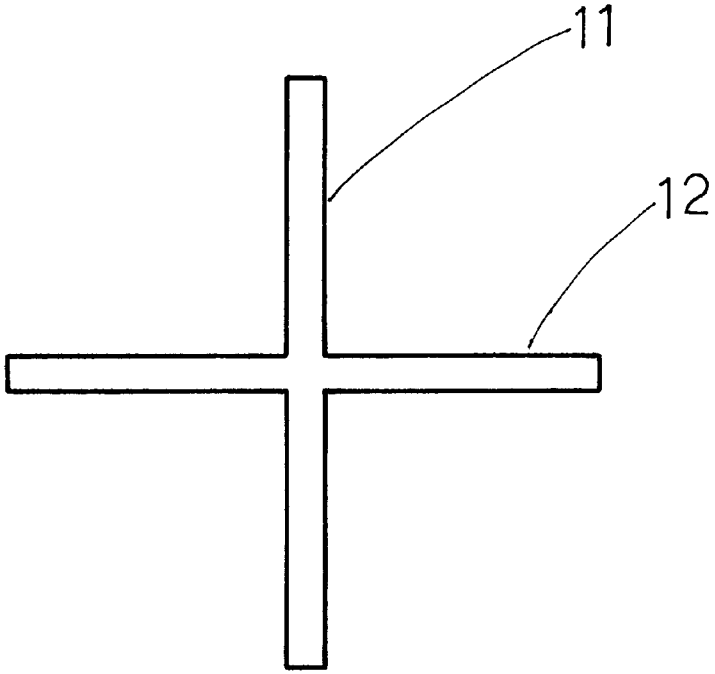
FIG. 2 is an enlarged view of the main form of stick fuselage which showing that the main form has a cruciform.

FIG. 2 shows a cross sectional view of the main form of stick fuselage 1. It is illustrated that the main form of stick fuselage 1 is formed by a vertical slice 11 of stick fuselage and a lateral slice 12 of stick fuselage which cross through one another so as to have a cruciform. The area of the cruciform of the main form of stick fuselage 1 is based on the length and tensile strength of the stick fuselage 1.

Moreover, the main form of stick fuselage 1, main wing support framing 2, and the tail unit framing 3 are formed integrally by plastic material.

Figure 3A:
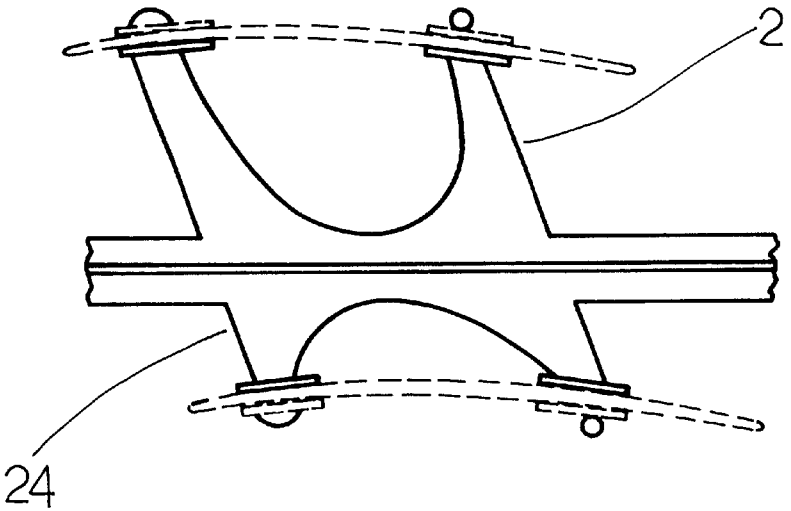
FIG. 3*a* is a schematic view showing the main wing structure of a biplane.
Figure 3:
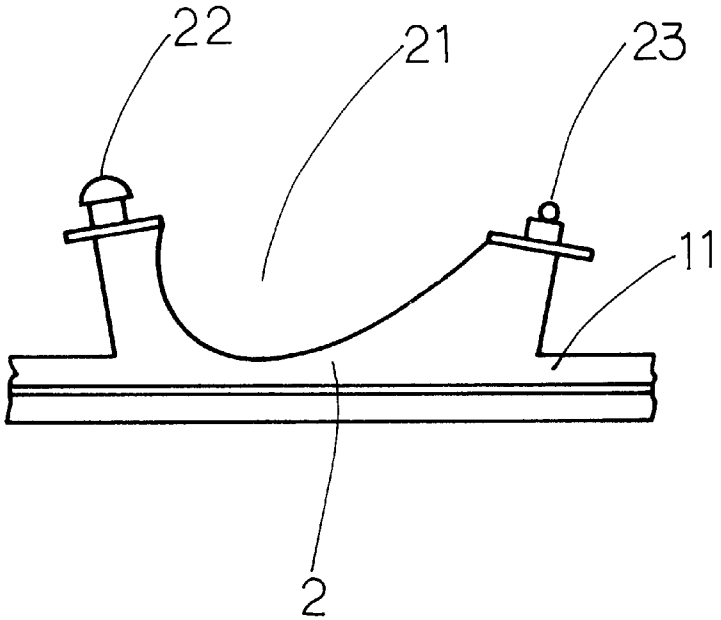
FIG. 3 is an enlarged view of the main wing support framing illustrated in FIG. 1.

FIG. 3 is an enlarged view of the main wing support framing 2. It is illustrated that a monoplane extended from the upper side of the vertical slice 11 of stick fuselage. In the drawing, the indication 21 is an irregular hollow portion for reducing the lateral effect of the fuselage. The front and rear main wing setting buttons 22 and 23 serve for installing the main wing and adjusting the incident angle of the main wing. FIG. 3*a* illustrates that a lower wing support framing 24 is installed at a lower side of the main wing support framing 2 for forming a biplane which is difficult in the conventional model plane. Moreover, using the same principle, a triplane can be formed.

Figure 4:
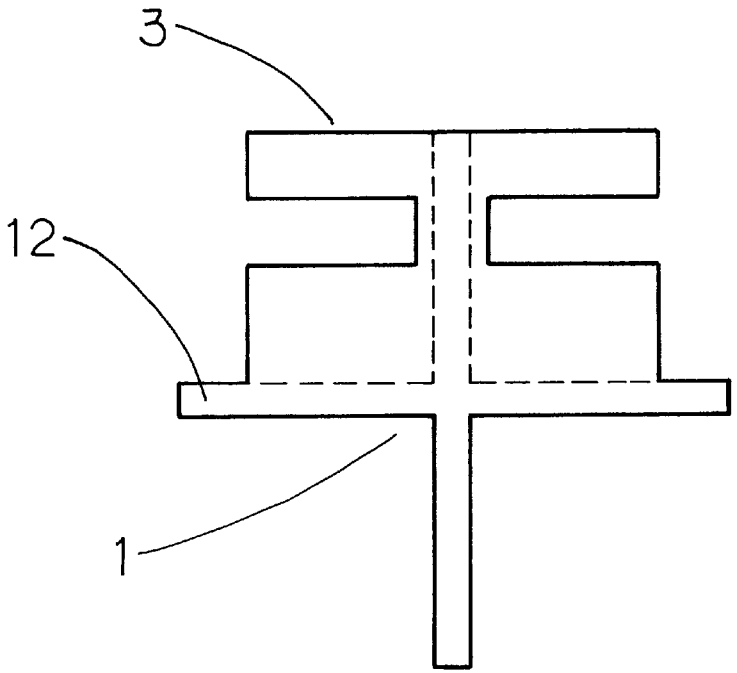
FIG. 4 is a cross sectional view of the tail unit framing which has a transverse H structure.

FIG. 4 is a cross sectional view of the tail unit framing 3 of FIG. 1. In that, an H structure extends from an upper surface of the lateral slice 12 of stick fuselage of the main form of stick fuselage 1. By this structure, it is only necessary to insert a jointer and thus a tail unit is formed. Thereby, the stabilizers has a stable structure.

Figure 4A:
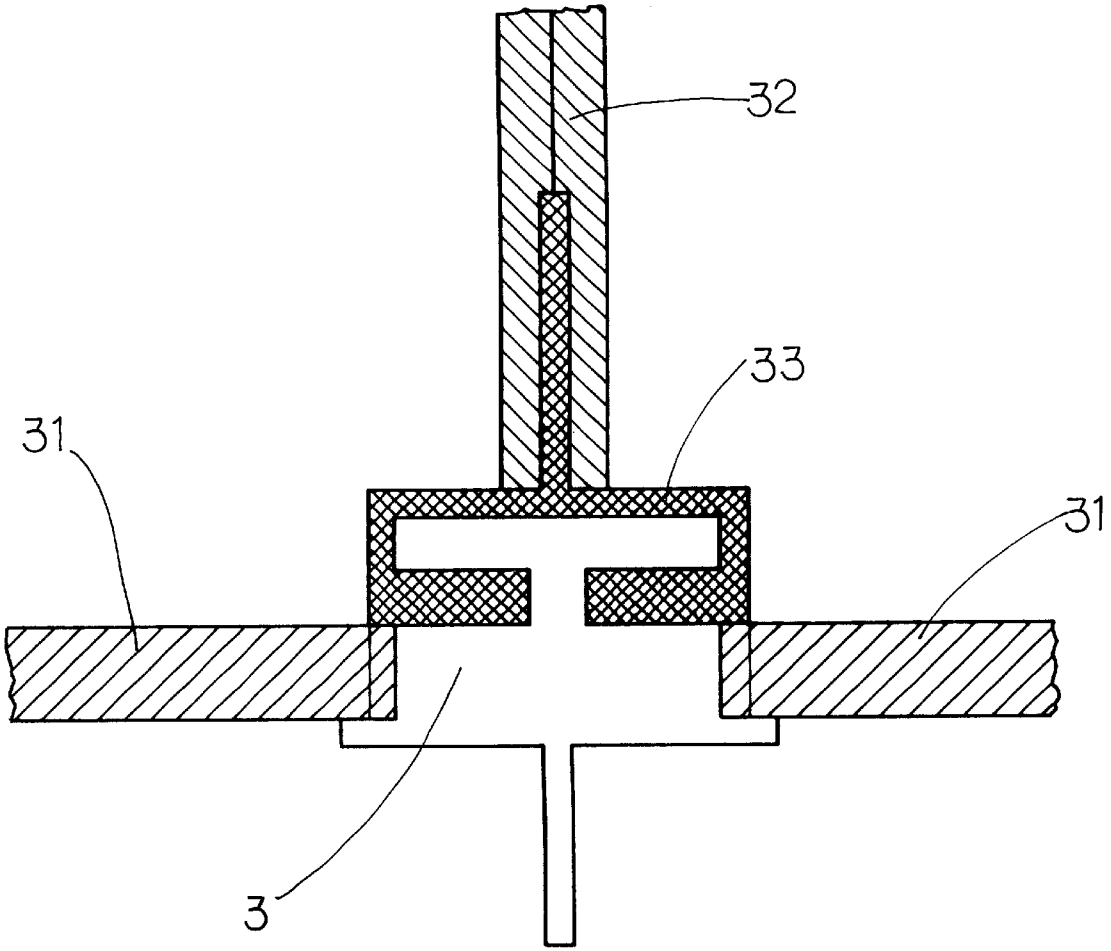
FIG. 4*a* is a schematic view showing the assembly of the stabilizers, wherein a jointer is used to assemble the turn T tail.
Figure 4B:
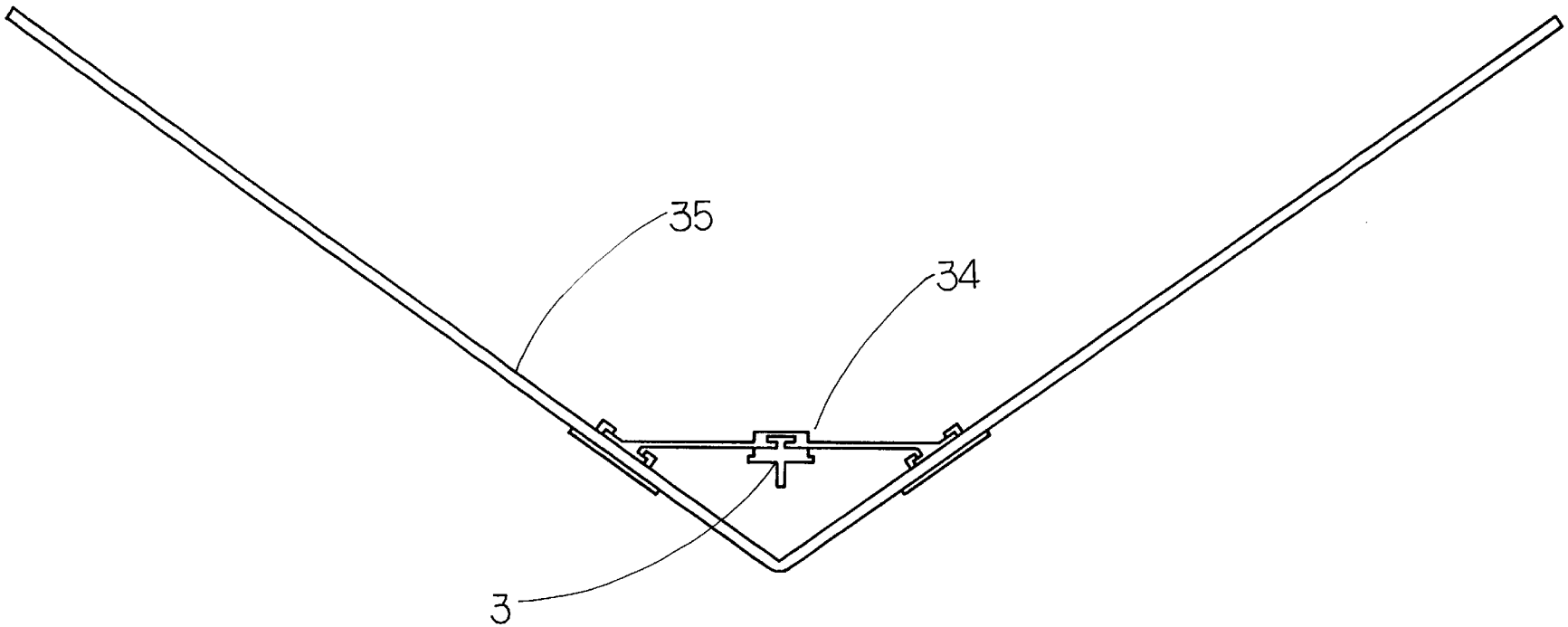
FIG. 4*b* is a schematic view showing the assembly of a V tail.

Referring to FIG. 4*a*, a cross sectional view of the horizontal tail 31 of the tail unit framing 3 is formed. Then the turn T tail jointer 33 is inserted for fixing. FIG. 4*b* is a schematic view of the same tail unit framing 3. If a V tail jointer 34 is inserted, than a different V tail 35 is formed.

Figure 5:
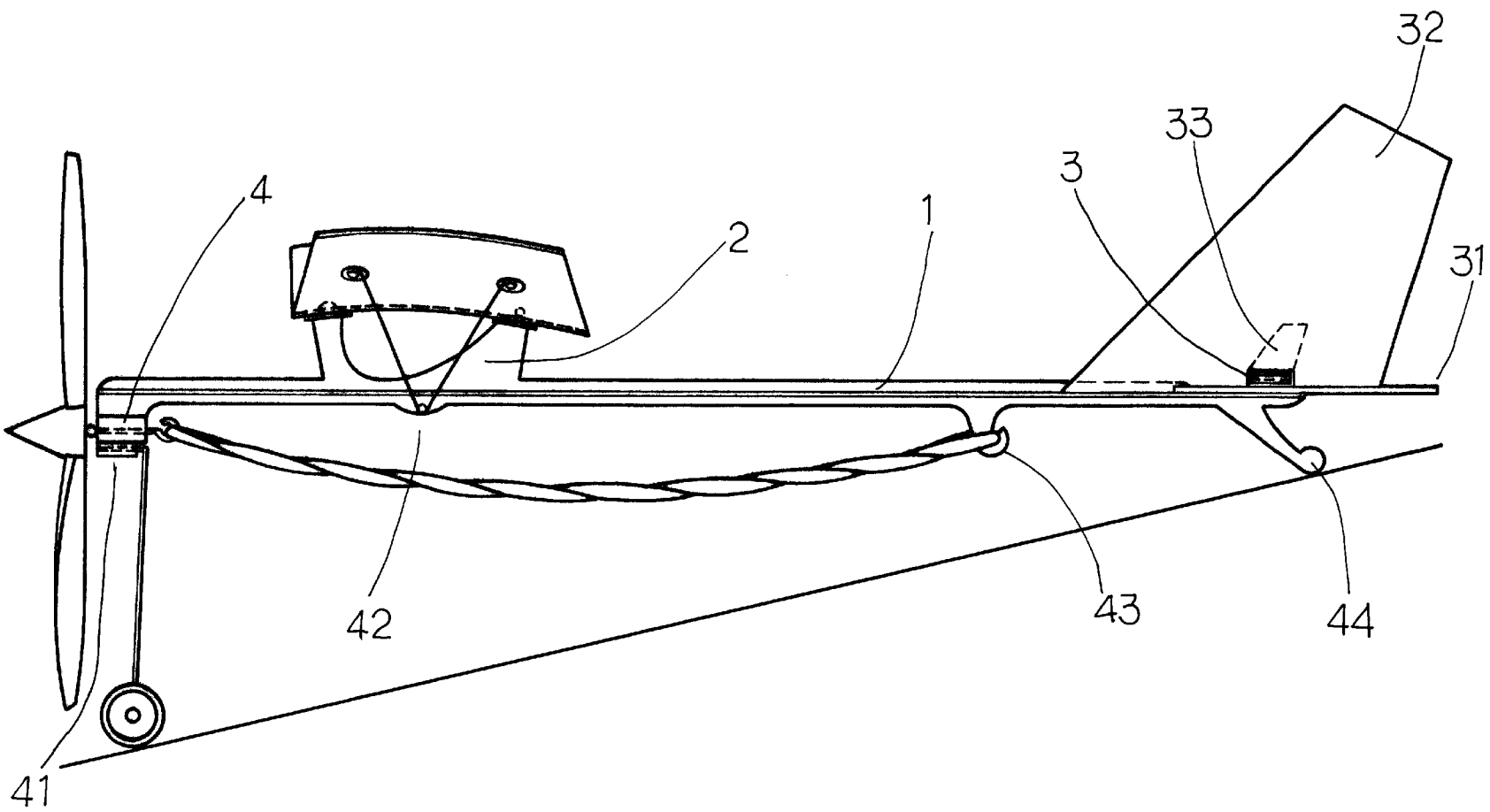
FIG. 5 shows that the stick fuselage of the present invention is assembled to a rubber power stick plane.

FIG. 5 is a lateral view showing that the present invention is used to a rubber power toy plane. It is illustrated that the toy plane includes a propeller axle bearing 4, a landing gear framing 41 under the propeller axle bearing 4, the dihedral bracket jointer 42 below the main wing support framing 2, a rear rubber hook 43, and a tail skid 44 which are integrally formed with the main form of stick fuselage 1.

Figure 6:
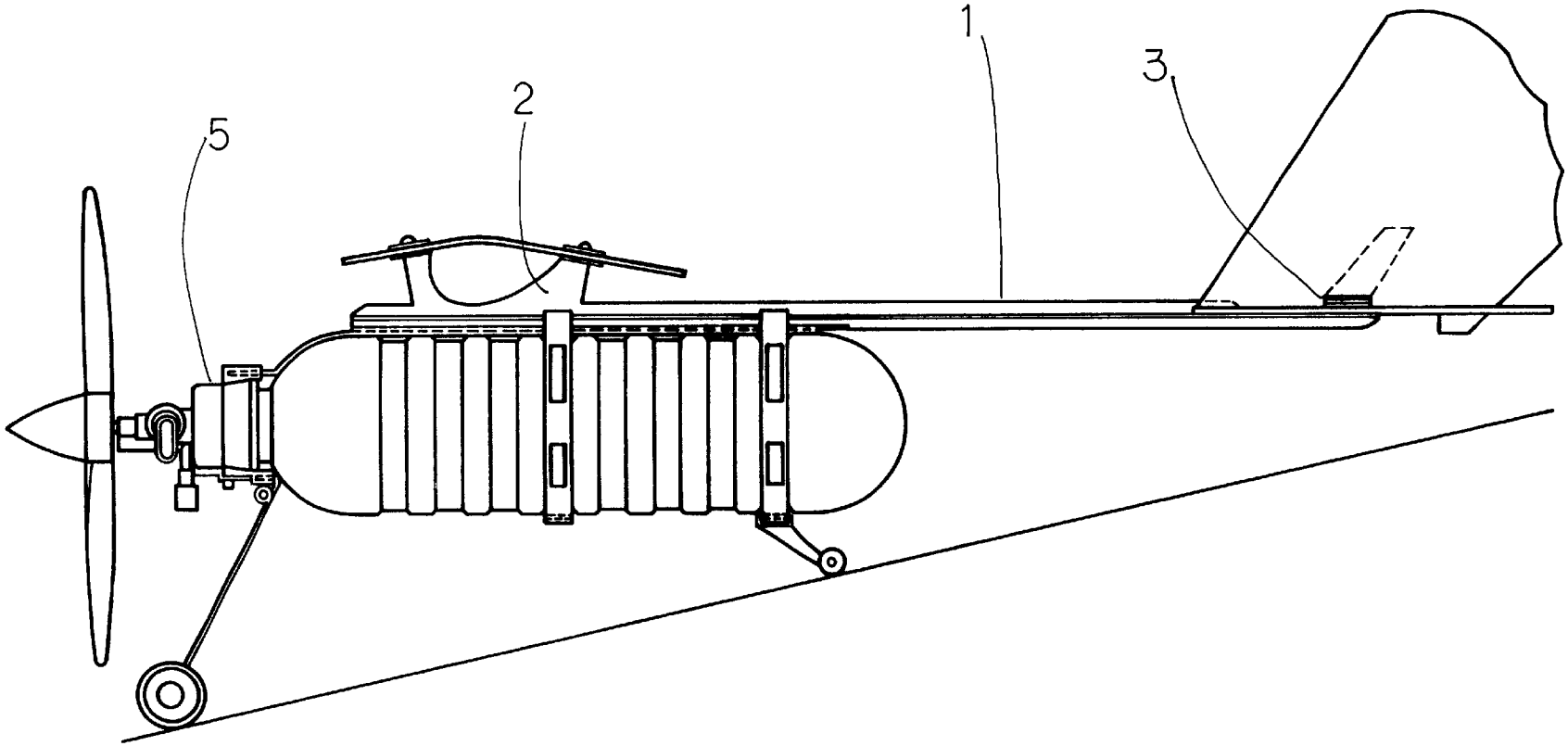
FIG. 6 shows that the present invention is used to a pneumatic-engine power stick plane.

FIG. 6 is a lateral view showing a pneumatic-engine power toy plane, includes a pneumatic-engine power system 5,and the present invention includes the main form of stick fuselage 1, main wing support framing 2 and tail unit framing 3 which are integrally formed.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A stick fuselage of a toy plane comprising a main form having a cruciform cross section which includes a vertical slice and a lateral slice, a main support framing adapted to be connected to a main wing and a tail unit framing adapted to be connected to a tail unit being integrally formed with the main form of stick fuselage respectively, the tail unit framing including an H structure extending from an upper surface of the lateral slice of the stick fuselage of the main form of stick fuselage, and a T tail jointer engaged with the H structure of the tail unit framing and a vertical tail connected to the T tail jointer.

2. A stick fuselage of a toy plane as claimed in claim 1, wherein the main wing support framing includes a front and rear main wing setting buttons.

* * * * *